US005247272A

United States Patent [19]

Matsuyama et al.

[11] Patent Number: 5,247,272

[45] Date of Patent: Sep. 21, 1993

[54] DIPOLE COIL AND STRUCTURE FOR USE IN THE MANUFACTURE THEREOF

[75] Inventors: Chiaki Matsuyama; Hiroaki Morita, both of Kobe; Yasuo Kannoto, Takasago; Hisashi Sekimoto, Takasago; Youichi Iwamoto, Takasago, all of Japan

[73] Assignees: Ship & Ocean Foundation; Mitsubishi Jukogyo Kabushiki Kaisha, both of Tokyo, Japan

[21] Appl. No.: 729,583

[22] Filed: Jul. 15, 1991

[30] Foreign Application Priority Data

Aug. 7, 1990 [JP] Japan ..... 2-207587

[51] Int. Cl.[5] ..... H01F 5/08

[52] U.S. Cl. ..... 335/299; 335/216; 335/213

[58] Field of Search ..... 335/213, 216, 299; 505/705, 879

[56] References Cited

U.S. PATENT DOCUMENTS

| | | | |
|---|---|---|---|
| 3,626,341 | 12/1971 | Dao | 335/216 |
| 4,038,622 | 7/1977 | Purcell | 335/216 |
| 4,189,693 | 2/1980 | Satti | 335/216 |
| 4,301,384 | 11/1981 | Gaines | 310/11 |
| 4,554,731 | 11/1985 | Borden | 29/605 |
| 5,027,098 | 6/1991 | Okazaki et al. | 335/213 |

FOREIGN PATENT DOCUMENTS

| | | | |
|---|---|---|---|
| 0190907 | 8/1986 | Japan | 335/216 |
| 0055905 | 3/1987 | Japan | 335/216 |
| 0210604 | 9/1987 | Japan | 335/216 |
| 0009904 | 1/1988 | Japan | 335/216 |
| 0051605 | 2/1989 | Japan | 335/216 |
| 1134515 | 11/1968 | United Kingdom . | |

OTHER PUBLICATIONS

Patent Abstracts of Japan, vol. 12, No. 69 (E-587) Mar. 3, 1988.

Patent Abstracts of Japan, vol. 10, No. 133 (E-404) May 17, 1986.

*Primary Examiner*—Leo P. Picard

*Assistant Examiner*—Raymond Barrera

*Attorney, Agent, or Firm*—Wenderoth, Lind & Ponack

[57] ABSTRACT

A dipole coil for use in a superconducting electromagnet employs two saddle-shaped coils in a diametrically opposed relationship. Each of the saddle-shaped coils includes central linearly extending portions, and curved saddle portions at the ends of the coil, respectively. A trapezoidal curved portion spacer is wedged into place against part of the saddle portion of the coil at the end thereof so as to exert a compressive force on such part which will inhibit displacement of the coil windings when an electromagnetic force acts thereon. In this way, friction at the coil is suppressed so as to prevent quenching. At the other end of the coil, the trapezoidal spacer includes a triangular member and a trapezoidal member spaced from one another so as to define a passageway. Leads of the coil are respectively accommodated in such passageways to prevent an excessive force from acting thereon. In this way, damage to the leads is also prevented.

5 Claims, 4 Drawing Sheets

FIG. 1
PRIOR ART
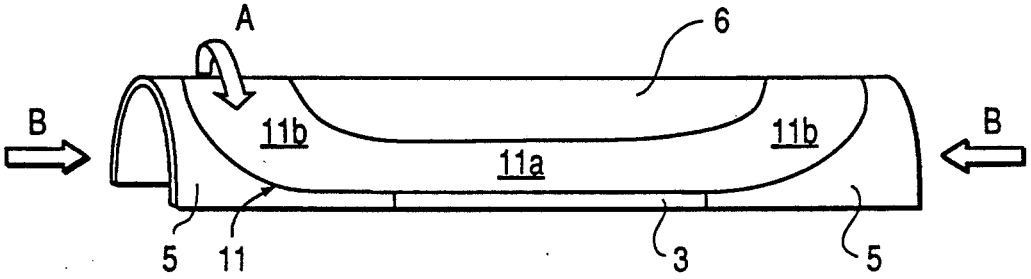
FIG. 2
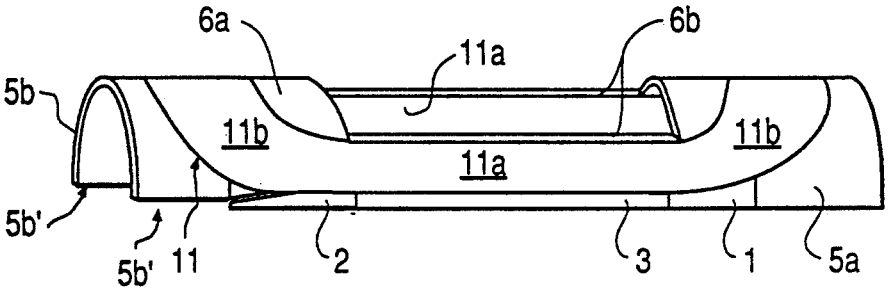
FIG. 3a
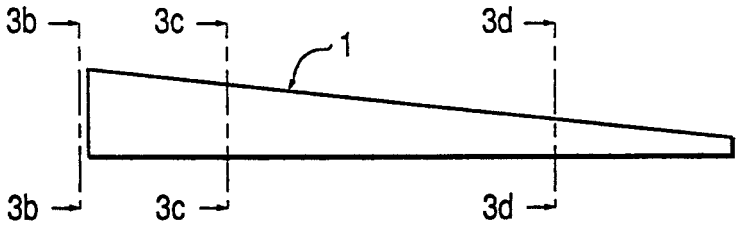
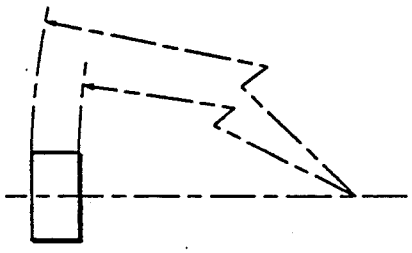
FIG. 3b
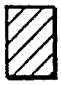
FIG. 3c
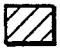
FIG. 3d

DIPOLE COIL AND STRUCTURE FOR USE IN THE MANUFACTURE THEREOF

BACKGROUND OF THE INVENTION

1. Field of the Invention

The present invention relates to a dipole coil and, in particular, a dipole coil including saddle-shaped coils forming the constituent element of a superconducting electromagnet.

2. Description of the Related Art

Superconducting electromagnets formed of a dipole coil structure including saddle-shaped coils are known in the prior art. One such saddle-shaped coil and the elements associated therewith in the dipole coil structure are illustrated in FIG. 1.

In this figure, reference numeral 11 designates a saddle-shaped coil, reference numeral 3 designates a straight portion spacer, reference numerals 5 designate end plates, respectively, and reference numeral 6 designates inner spacer structure not shown in any particular detail.

The saddle-shaped configuration of coil 11 is constituted by both linear central portions of the coil, one of which is designated by reference 11*a*, and curved saddle portions 11*b* of the coil located at opposite ends of the coil, respectively. These curved saddle portions 11*b* extend contiguously with the central portions 11*a* from locations at which the linearly extending central portions of the coil begin to assume a curved configuration.

In the fabrication of the dipole coil structure of the prior art, wire of a superconducting alloy is wound around spacer structure 6 over an inner lining of a cylindrical form (not shown) to thereby form the saddle-shaped coil 11. Subsequently, the straight portion spacers 3 are butted against the sides of the linear central portions 11*a* of the coil with such a force as to cause a compression of the linear central portions of the coil in the direction indicated by arrow A. This direction corresponds to the circumferential direction of the inner lining on which the coil 11 is wound. End plates 5 are butted against the curved saddle portions 11*b* and therefore, generally compress the saddle portions 11*b* in the direction indicated by arrows B (axial direction of the inner lining). The purpose of precompressing the coil 11 in the manner described above will now be explained.

When the superconducting electromagnet employing the structure described above is operated, an electromagnetic force is generated which acts on the coil itself. This electromagnetic force tends to displace various windings of the coil relative to one another. Such relative displacements of the coil in turn create friction giving rise to increases in temperature at various local portions of the coil. These increases in temperature can take the alloy of the coil outside its critical temperature range whereupon the coil loses its superconducting capability at the above-mentioned local portions. Such a condition represents the germination of so-called quenching.

That is, when the local portions of the coil no longer exhibit superconductivity due to the temperature increases thereof, the local portions conduct in an ordinary manner and thus necessarily generate some quantity of ohmic heat (Joule's heat). This ohmic heat has an additive effect on the above-described temperature increases resulting in further quenching.

Accordingly, it was desired to prevent the relative displacement of the coil windings in the prior art by the use of the above-described spacers 3 and end plates 5.

However, it is difficult to confine (precompress) each local portion of the coil, in a manner which will prevent relative displacement of the windings thereof, due to the saddle-shaped configuration of the coil. In this respect, it should be noted that the maximum electromagnetic force acts at that location on the saddle-shaped coil where the linearly extending central portions 11*a* of the coil begin to assume the curved configuration of the saddle portions 11*b*.

As discussed above, in the prior art superconducting electromagnet, the end plates 5 are effective to precompress the saddle portions 11*b* of the coil in the axial direction of arrows B.

However, as should now readily be appreciated, these end plates 5 exert substantially no compressive force on the coil at those locations at which the linearly extending central portions 11*a* of the coil begin to assume the curved configuration of the saddle portions 11*b*. In other words, the axial force in the direction of arrows B have substantially no component which will act to compress the coil 11 in a direction perpendicular to the windings thereof at those portions of the end plates 5 butting against the ends of the spacers 3.

And, since it is at these locations where the maximum electromagnetic force acts on the coil itself, each curved portion of the coil where a central portion 11*a* and a saddle portion 11*b* merge is a place where quenching frequently occurs.

In addition, it may be considered to use further straight spacers at the ends of the central spacer 3 so as to exert compressive forces in the direction of arrow A on those portions of coil where the linear central portions 11*a* begin to assume the curved configuration of the saddle portions 11*b*. However, such a solution would produce a sharp step between the central spacer 3 and the further straight spacers. Not only would such a step define a small space where absolutely no compressive force would be exerted on the coil, but such a sharp step would provide poor insulation and could also damage the wire or cable of the coil.

SUMMARY OF THE INVENTION

It is therefore one object of the present invention to provide dipole coil structure which is capable of exerting a compressive force (in a radial direction) along the entirety of a saddle-shaped coil, particularly at those locations where the linearly extending central portions of the coil begin to assume the curved configuration of the saddle-shaped portions. In this way the tendency of such a coil to exhibit quenching in a superconducting electromagnet is considerably reduced compared to the prior art.

To achieve such an object, the present invention employs a curved portion spacer in the form of a wedge-shaped, specifically trapezoidal, element extending alongside the terminal part of the saddle-shaped portion of the coil, so as to exert a compressive force on that part of the coil which will "tighten" the windings at that part of the coil against one another, thereby inhibiting displacement of the windings relative to one another under the electromagnetic force generated by the coil.

A further object of the present invention is to provide a spacer in dipole coil structure which will not only facilitate the generation of a compressive force as described above, but which will also serve to accommodate and protect leads of the coil.

To achieve this further object of the present invention, a trapezoidal spacer is formed of a triangular member and a trapezoidal member spaced from one another so as to define a passageway therebetween. The leads of the coils can be accommodated in such passageways, respectively, whereby the lead wires are not subject to excessive forces.

Since a relative displacement of the windings constituting all curved parts of the saddle portion can be inhibited by the use of the trapezoidal spacer according to the present invention, quenching is hardly produced. And, owing to the fact that some of such trapezoidal spacers are constituted by triangular and trapezoidal members between which leads of the coils are accommodated, there is no possibility of such leads becoming damaged.

BRIEF DESCRIPTION OF THE DRAWINGS

The above-mentioned and other objects, features and advantages of the present invention will become more apparent by referring to the following detailed description of the preferred embodiment of the present invention taken in conjunction with the accompanying drawings.

In the accompanying drawings:

FIG. 1 is a schematic perspective view of dipole coil structure of the prior art;

FIG. 2 is a schematic perspective view of dipole coil structure according to the present invention;

FIG. 3*a* is a front view of a first curved portion spacer of the dipole structure according to the present invention;

FIG. 3*b* is an end view of the first curved portion spacer taken in the direction of arrows 3*b*—3*b* of FIG. 3*a*;

FIGS. 3*c* and 3*d* are cross-sectional views of the curved portion spacer taken along lines 3*c*—3*c* and 3*d*—3*d*, respectively, of FIG. 3*a*;

DETAILED DESCRIPTION OF THE PREFERRED EMBODIMENT

Figure 4A:
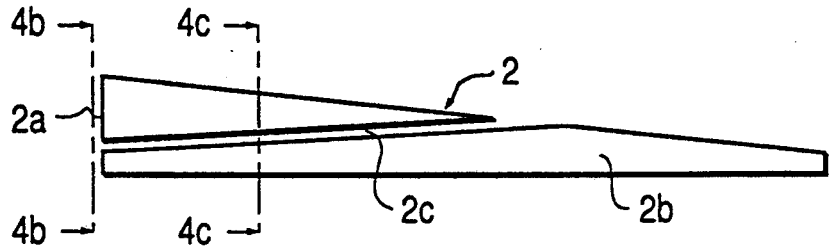
FIG. 4*a* is a front view of a second curved portion spacer of the dipole structure according to the present invention.

A preferred embodiment of dipole coil structure according to the present invention will first be described with reference to FIGS. 2–4. It is to be noted that like parts are designated by like reference numerals throughout the drawings.

The dipole coil structure shown in FIG. 2 is generally similar to that of the prior art shown in FIG. 1 and is manufactured using much of the same techniques. Accordingly, a detailed description thereof is omitted for the sake of brevity. Reference numeral 11 designates a saddle-shaped coil including linear central portions 11*a*, and curved saddle portions 11*b* located at ends of the coil, respectively.

Reference numeral 3 designates one of a pair of straight portion spacers respectively provided on opposite sides of the structure shown in FIG. 2. Each straight portion spacer 3 has a substantially rectangular shape and extends alongside a respective central portion 11*a* of the coil 11. Further, each straight portion spacer 3 has opposite ends terminating alongside locations at which a central portion 11*a* of the coil merges into the curved saddle portions at the opposite ends of the coil, respectively. As previously described these are the locations from which the linear central portions 11*a* immediately begin to assume the curved configuration of the saddle portions.

Reference numeral 1 designates one of a pair of first curved portion spacers respectively provided on opposite sides of the dipole coil structure. As best shown in FIG. 3*a*, the curved portion spacer 1 has a trapezoidal shape in which the height thereof decreases from end to end (FIGS. 3*b*–3*d*).

Figure 4B:
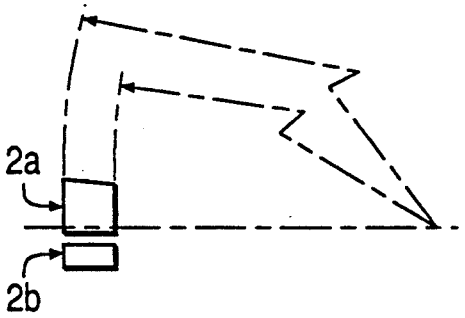
FIG. 4*b* is an end view of the second curved portion spacer taken in the direction of arrows 4*b*—4*b* of FIG. 4*a*.
Figure 4C:
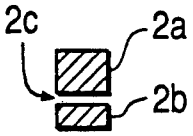
FIG. 4*c* is a cross-sectional view of the second curved portion spacer taken along lines 4*c*—4*c* of FIG. 4*a*.

On the other hand, reference numeral 2 designates one of a pair of second curved portion spacers 2 respectively provided at opposite sides of the dipole coil structure at an opposite end of the coil. As best shown in FIG. 4*a*, the second curved portion spacer 2 also has an overall trapezoidal shape. And, as shown in each of FIGS. 4*a*–4*c*, the second curved portion spacer 2 comprises a triangular member 2*a* and a trapezoidal member 2*b* spaced from one another so as to define a passageway 2*c* therebetween, for a purpose to be described later.

Reference 5*a* designates a first end plate butted against the side of the end part of the saddle portions 11*b* of the coil, so as to exert an axial force (corresponding to arrow B in FIG. 1) which will compress the windings of the coil at such end part. The first spacer 1 is interposed between the straight portion spacer 3 and the end plate 5*a*. The first curved portion spacer 1 thus extends from an end of the straight portion spacer 3 alongside part of a curved saddle portion 11*b* of the coil 11. The short end of the first curved portion spacer butts against the end of the straight portion spacer while the taller end butts against the end of the end plate 5*a*.

On the other hand, reference 5*b* designates a second end plate designed to have a lead wire mount section 5*b*′ communicating with the passageway 2*c* of the second curved portion spacer 2. Similar to the first end plate 5*a*, the second end plate 5*b* is butted against the side of the end part of the saddle portion 11*b* of the coil so as to exert an axial force thereon having a major component in a direction perpendicular to the windings at such part. The second curved portion spacer, defining the passageway 2*c* therethrough, is interposed between the straight portion spacer 3 and the end plate 5*b* having the lead wire mount section 5*b*′. Bandshaped leads of the coil 11 extend through the passageways 2*c* of the second curved portion spacers 2 and are respectively mounted in the device within the lead wire mount sections 5*b*′ of the end plate 5*b*.

References 6*a*, 6*b* represent curved and straight portion inner spacers which together constitute inner spacer structure similar to that of the structure 6 discussed above in connection with FIG. 1.

Figure 5:
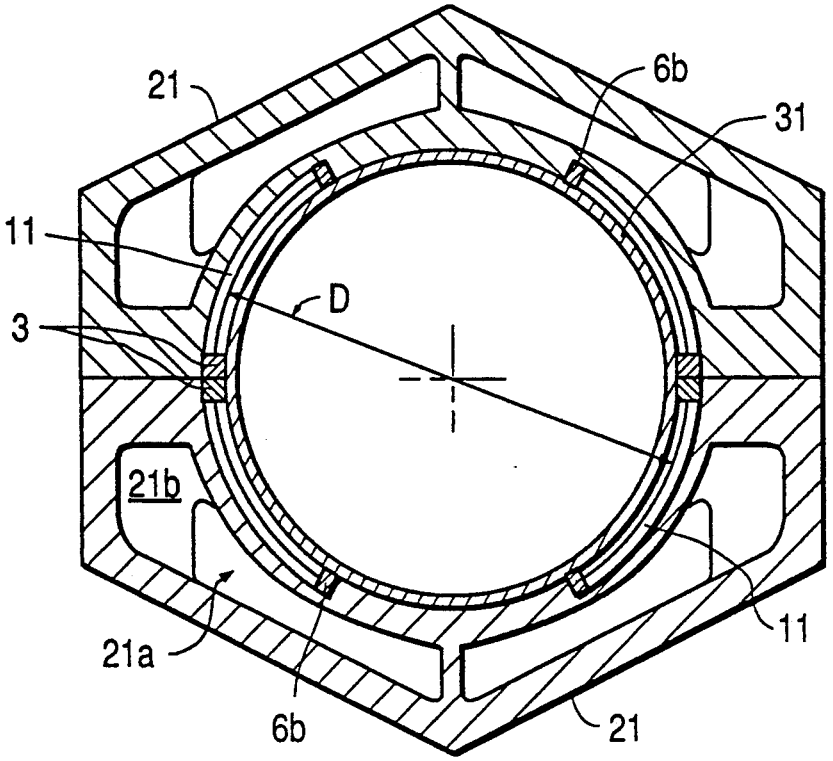
FIG. 5 is a cross-sectional view of a dipole coil of a superconducting electromagnet according to the present invention.

As shown in FIG. 2, the saddle-shaped coil 11, spacers 1 and 2 and end plates 5*a*, 5*b* have an overall form of a semicylindrical column, i.e. these elements lie in a common semicylindrical plane. FIG. 5 is a cross-sectional view of a dipole coil (superconducting electromagnet) comprising two assemblies of the elements described above in connection with FIG. 2.

In the dipole coil shown in FIG. 5, the two dipole structure assemblies are superposed in a diametrically opposed relationship, and the elements thereof are secured within two halves of a coil presser 21. These halves are fixed to one another by appropriate fasteners (not shown). Reference 21*b* designates one of a plurality of passages through the coil presser 21 for accommodating cooling medium, such as liquid helium, intended to maintain the coils at a critical superconducting temperature. Reference 21*a* designates one of a plurality of fins of the coil presser extending into the passages 21*b*. And, reference numeral 31 designates an inner lining, typically a stainless steel tube, over which the windings constituting the coils 11 are wound. Finally, it should be noted that the external shape of the coil presser 21 (flat surfaces) allows for the dipole coils to be arranged side-by-side in an annular array.

In fabricating the superconducting electromagnet of FIG. 5, a cable containing strands of a superconducting alloy (NbTi) is wound over the inner tube around the inner spacer structure, and is heated with the end plates 5*a*, 5*b* pressed thereagainst under a force generally in the order of 300 tons to fix the saddle shape of the coil 11. Such structure is then disposed in a press with the spacers 1, 2 and 3, and the coil presser halves. A force generally in the order of 1000 tons is exerted on the coil presser halves, whereupon the wedge shape of the trapezoidal curved portion spacers 1, 2 acts to compress the parts of the saddle portions 11*b* of the coil adjacent thereto in the circumferential direction of the inner tube 31, i.e. in a direction having a major component perpendicular to the direction of the windings of the coil 11. This compressive force is thus exerted on those parts of the saddle portions 11*b* of the coil from the exact location at which the curved saddle portion merges with a linear central portion 11*a* to a location (at the taller end of the curved portion spacer) spaced therefrom along the curved saddle portion. The curved portion spacer 1 has an end-to-end length which is ⅓ of the coil diameter D (120 mm, 360 mm, respectively, for example). The compressive force is designed to be sufficient to inhibit relative displacement of the windings of the coil, under the electromagnetic force generated by the coil, to a degree which will prevent quenching at that part of the coil.

The straight portion spacers similarly are forced against the central linear portions 11*a* of the coil and exert compressive forces thereon. Then, the halves of the coil presser 21 are fixed to one another with the spacers 1, 2 and 3 in place whereby the coils 11 remain precompressed along the entirety thereof. It should be clear that this compressive force is a normal force resisting the tendency of the coil windings to displace in directions which will generate friction.

Figure 6A:
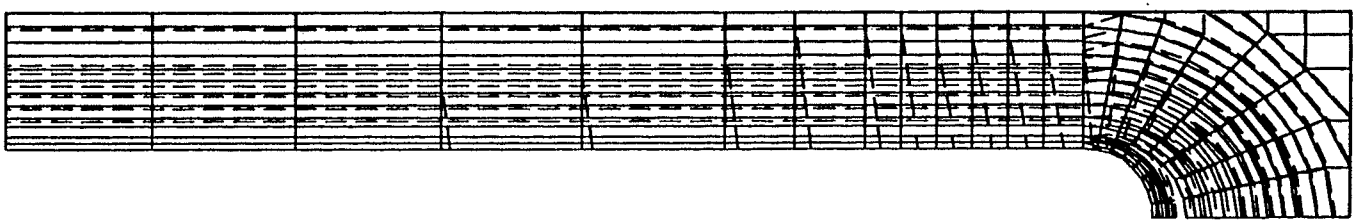
FIGS. 6*a* and 6*b* are calculated displacement diagrams of the present invention, FIG. 6*a* illustrating the displacement at both linear and curved portions of the coil and FIG. 6*b* being an enlargement of the curved portion.
Figure 6B:
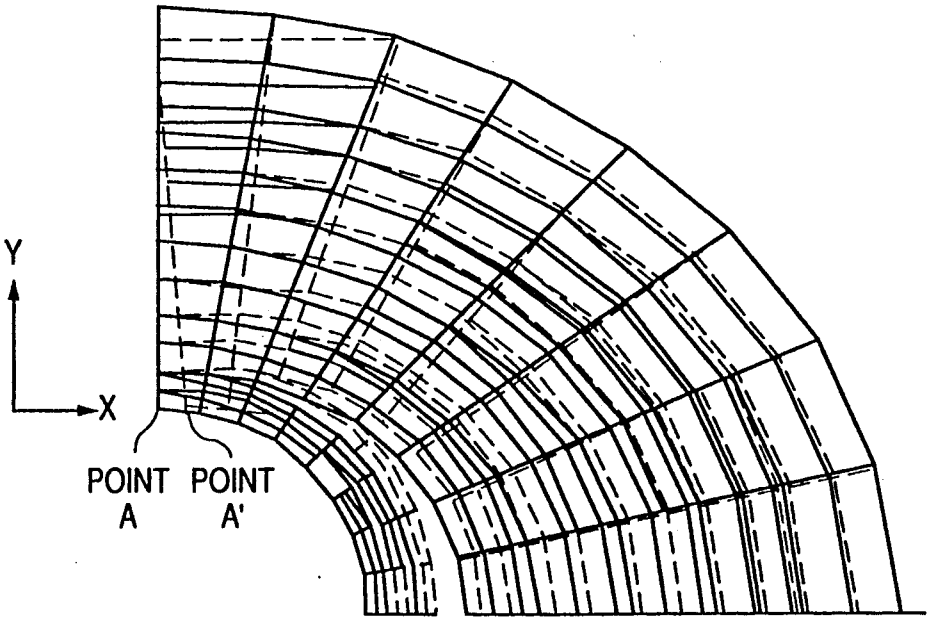
Figure 7A:
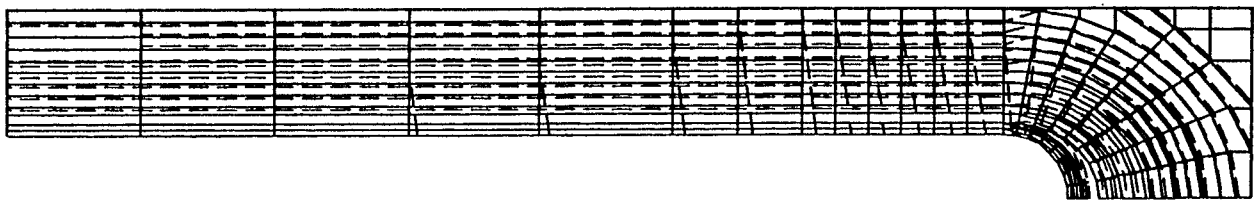
FIG. 7a PRIOR ART
FIGS. 7*a* and 7*b* are calculated displacement diagrams of the prior art dipole coil, FIG. 7*a* illustrating the displacement at both linear and curved portions and FIG. 7*b* being an enlargement of the curved portion shown in FIG. 7*a*.
Figure 7B:
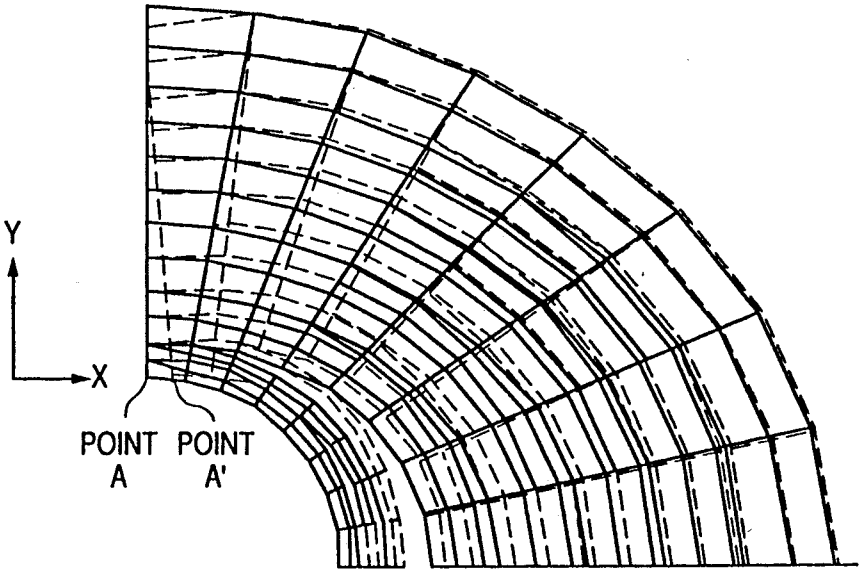
FIG. 7b PRIOR ART

FIGS. 6*a*, 6*b* are calculated deformation diagrams illustrating the displacement of the coil in the dipole coil structure according to the present invention when an electromagnetic force acts thereon. For purposes of comparison, FIGS. 7*a*, 7*b* are calculated deformation diagrams of the prior art structure shown in FIG. 1, in which only the straight portion spacers 3 can effect a significant compression of the coil in the direction of arrow A. In these figures, the solid lines represent a non-actuated state of the coils, while the dotted lines represent the state of the coils once an electromagnetic force has been generated.

Although both FIGS. 6 and 7 show that point A will displace to the location of point A', a large difference can be observed in the magnitude of such displacements. Such a difference as analyzed is indicated in the table below.

| | Displacement of Point A | |
|---|---|---|
| | Prior Art | Present Invention |
| x-direction | 2.323 | 1.953 |
| y-direction | 0.362 | 0 |

From the above data, it can be seen that the present invention represents a remarkable improvement of the prior art with respect to suppressing displacement of the coil windings at that location (point A) where the magnet field is strongest. And as discussed above, because the displacement of the coil windings at the terminal end of the saddle portion (where the curved saddle portion merges with the linear central portion of the coil) is suppressed to a significant extent according to the present invention, little friction is generated upon the application of an electromagnetic force whereby quenching is prevented. And due to the fact that the band-shaped leads of the coils are accommodated in the passageways defined by the second curved portion spacers 2, excessive forces cannot act on such leads and damage thereof is prevented.

While a principle of the present invention has been described above in connection with a preferred embodiment, various changes and modifications will become apparent to those of ordinary skill in the art. Therefore, all such changes and modifications are seen to be within the true spirit and scope of the invention as defined by the appended claims.

What is claimed is:

1. A dipole coil comprising:

an inner cylindrical lining;

a first coil disposed over said inner lining and having a saddle-shaped configuration constituted by both linear central portions of the coil extending axially of said lining and curved saddle portions of the coil located at opposite ends of the coil, respectively, and which curved saddle portions extend contiguously with said central portions;

a second coil disposed over said inner lining generally diametrically opposite said first coil, said second coil also having a said saddle-shaped configuration;

a straight portion spacer having a substantially rectangular shape, extending alongside each central portion of the coils, and having opposite ends each terminating alongside a location at which a central portion of one of the coils merges with a curved saddle portion thereof;

a first curved portion spacer having a trapezoidal shape, extending from one of the ends of a said straight spacer alongside part of a curved saddle portion of each of said coils at one of the opposite ends of said coils, and exerting a compressive force in the circumferential direction of said lining on said part of a curved saddle portion of each of said coils;

a second curved portion spacer having a trapezoidal shape, extending from the other of the ends of a said straight portion spacer alongside part of a curved portion of each of said coils at the other of the opposite ends of said coils, and exerting a compressive force in the circumferential direction of said lining on said part of a curved portion of each of said coils at the other of the opposite ends thereof; and a coil presser extending over said coils and maintaining said coils and said spacers over said inner lining.

2. A dipole coil as claimed in claim 1, wherein each said second curved portion spacer comprises a triangular member and a trapezoidal member spaced from one another so as to define a passageway therebetween, and said coils include leads extending through the passageways, respectively.

3. Dipole coil structure comprising:

an inner lining extending in a cylindrical plane;

a coil disposed over said inner lining and having a saddle-shaped configuration constituted by both linear central portions of the coil extending axially of said lining and curved saddle portions of the coil located at opposite ends of the coil, respectively, and which curved saddle portions extend contiguously with said central portions;

a straight portion spacer having a substantially rectangular shape, extending alongside at least one of the central portions of said coil, and having opposite ends terminating alongside locations at which said at least one of the central portions of said coil merges with the curved saddle portions at the opposite ends of the coil, respectively; and at least one curved portion spacer having a trapezoidal shape, and extending from one of the ends of said straight portion spacer alongside part of a respective curved portion of said coil.

4. Dipole coil structure as claimed in claim 3, wherein said at least one curved portion spacer comprises a triangular member and a trapezoidal member spaced from one another so as to define a passageway therebetween.

5. A method of precompressing a coil during the fabrication of dipole coil structure, said method comprising:

forming a superconducting alloy, over an inner lining extending in a cylindrical plane, into a saddle-shape coil constituted by both linear central portions extending axially of the lining and curved saddle portions located at opposite ends of the coil and extending contiguously with each of the central portions;

exerting a compressive force in the circumferential direction of said lining on a part of a said curved saddle portion of the coil, from a location at which said curved saddle portion merges with a said linear central portion to a location spaced therefrom along said curved saddle portion; and said step of exerting including forcing a wedge-shaped spacer member into place in the dipole coil structure alongside and against said part of the curved saddle portion until a compressive force exerted thereby on said part of the curved saddle portion will inhibit displacement of said part of the coil under the electromagnetic force generated by the coil to a degree sufficient to prevent the occurrence of quenching at said part, and fixing said wedge-shaped spacer member in said place.

* * * * *